US006203408B1

(12) United States Patent
Quek

(10) Patent No.: US 6,203,408 B1
(45) Date of Patent: Mar. 20, 2001

(54) VARIABLE PRESSURE PLATE CMP CARRIER

(75) Inventor: Ser Wee Quek, Bedok (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 0 days.

(21) Appl. No.: 09/383,597

(22) Filed: Aug. 26, 1999

(51) Int. Cl.[7] ..... B24B 1/00
(52) U.S. Cl. ..... 451/41; 451/286
(58) Field of Search ..... 451/286–290, 451/388, 398, 41

(56) References Cited

U.S. PATENT DOCUMENTS

| | | | | |
|---|---|---|---|---|
| 3,747,282 | * | 7/1973 | Katzke | 451/388 |
| 5,423,558 | | 6/1995 | Koeth et al. | 279/3 |
| 5,423,716 | | 6/1995 | Strasbaugh | 451/388 |
| 5,441,444 | * | 8/1995 | Nakajima | 451/388 X |
| 5,476,414 | * | 12/1995 | Hirose et al. | 451/388 X |
| 5,527,209 | * | 6/1996 | Volodarsky et al. | 451/388 |
| 5,624,299 | | 4/1997 | Shendon | 451/28 |
| 5,651,724 | * | 7/1997 | Kimura et al. | 451/287 X |
| 5,681,215 | * | 10/1997 | Sherwood et al. | 451/398 X |
| 5,733,182 | * | 3/1998 | Muramatsu et al. | 451/388 X |
| 5,797,789 | * | 8/1998 | Tanaka et al. | 451/286 X |
| 5,800,248 | | 9/1998 | Pant et al. | 451/41 |
| 5,851,140 | | 12/1998 | Barns et al. | 451/288 |

* cited by examiner

*Primary Examiner*—Derris H. Banks
*Assistant Examiner*—Anthony Ojini
(74) *Attorney, Agent, or Firm*—George O. Saile; Rosemary L. S. Pike

(57) ABSTRACT

An apparatus for removably positioning a semiconductor wafer for polishing. The apparatus including a rotating member with a major lower surface having a plurality of recesses each with a conduit path radially leading to a smaller circular pattern of portholes disposed near the center of the rotating member, the recesses are arranged in concentric segments. A nozzle plate covers the major lower surface defining a plurality of chambers therebetween. The nozzle plate includes a radial pattern of gas dispensing orifices which are aligned centrally relative to each chamber. A preset regulated gas pressure communicates with each orifice pattern to exert an opposing force against a force urging the article against the polishing pad. At least two of the orifice patterns have gas pressures adjusted independently from one another so that independent pressure control creates varying forces to be exerted against the back side of the wafer.

17 Claims, 5 Drawing Sheets

FIG. 1 – Prior Art

FIG. 2 – Prior Art

VARIABLE PRESSURE PLATE CMP CARRIER

BACKGROUND OF THE INVENTION (1) Technical Field

This invention relates to a method which varies the amount of pressure applied to specific areas of a semiconductor during polishing and permits more accurate control of the polishing rate across the semiconductor surface when performing chemical mechanical polishing (CMP) to produce a uniform substrate surface.

(2) Description of the Prior Art

The following documents relate to a method for controlling a polishing rate across a substrate surface when performing CMP.

U.S. Pat. No. 5,423,716 issued Jan. 5, 1994 to Alan Strasbaugh describes an apparatus for holding a wafer which includes a soft, resilient membrane that covers a horizontal backing plate. The lower face of the backing plate includes a number of recessed areas to which vacuum can be selectively applied. By applying a pressurized fluid to the recessed areas during polishing, the membrane will exert a uniform downward pressure on the wafer and produce a uniformly polished surface.

U.S. Pat. No. 5,624,299 issued May 1, 1995 to Norman Shendon describes a carrier apparatus for positioning and biasing a substrate against a polishing pad. The device uses a membrane configured to create one or more vacuum regions which chuck the substrate to the membrane so that the carrier may move the substrate on and off the polishing pad.

U.S. Pat. No. 5,800,248 issued Apr. 26, 1996 to Anil K. Pant et al describes a support housing which underlies a polishing pad and includes a plurality of openings for dispensing a pressurized fluid.

The manufacture of an integrated circuit device requires the formation of various layers (both conductive and non-conductive) above a substrate to form the necessary components and interconnects. During the manufacturing process, certain layers or portions of layers must be removed in order to pattern and form the various components and interconnects. Chemical mechanical polishing (CMP) is the method of choice for planarization of a surface of a semiconductor wafer, such as a silicon wafer, at various stages of the integrated circuit processing. CMP is also used to flatten optical surfaces, metrology samples and in various metal and semiconductor based substrates.

CMP is a technique in which a chemical slurry is used in conjunction with a mechanical polishing pad to polish away materials on a semiconductor wafer. The mechanical movement of the pad relative to the wafer (and in conjunction with the slurry) provides the abrasive force to polish the exposed surface of the wafer. In the most common form of CMP, a substrate is mounted on a polishing head which rotates against a polishing pad placed on a rotating table. The mechanical force derives from the rotating table speed and the downward pressure on the head. The chemical slurry is constantly transferred under the polishing head. Rotation of the polishing head helps in the slurry delivery as well as in averaging the polishing rates across the substrate surface. A constant problem of CMP is that the polishing rate varies from the periphery to the center of the wafer for various reasons. Pad bounce is one reason. Variations in the velocity encountered in the rotational movement is another. Some amount of averaging is achieved by rotating the wafer but variations still result in non-uniform polishing across the wafer surface. It is an important goal in the CMP processing to try to minimize this inequality in polishing rates.

One approach utilizes a linear polisher as opposed to a rotating one. A moving belt linearly moves the pad across the wafer surface. The wafer is still rotated for averaging out the local variations, but the global planarity is improved over CMP tools using rotating pad.

SUMMARY OF THE INVENTION

Currently all carrier types have holes in the base to allow vacuum pressure to hold the wafer in place or to push the wafer down using nitrogen or compressed dry air during CMP. The problem has been that all the holes receive the same amount of vacuum or air pressure applied since there is only one regulated source of supply. The result is, with new carrier film and pad, that the wafer tends to polish faster at the center and more slowly at the outer perimeter Over a period of time, the edge will polish faster and the center more slowly.

This invention describes a technique for controlling a polishing rate across a substrate surface in order to obtain a uniform polishing of the substrate surface This invention provides a method for varying the pressure/vacuum to accommodate for changes in the surface of the carrier film over time. The device permits the increase or decrease of pressure applied onto the wafer on any of multiple specific areas and ensures good planarization throughout the life of the consumable (carrier film, polishing pad); it can also prolong the useful life of the consumable.

By having the ability to better control the amount of pressure/vacuum applied to certain areas of the wafer, the invention can fine-tune the polishing procedure and produce a more uniform wafer.

The present invention describes a technique for controlling the polishing rate across a substrate surface during polishing by applying different pressures to a plurality of designated sites of any configuration. A support housing includes a plurality of openings through a shaft for individualized regulated gas pressures. These openings are arranged in a reconfigured pattern to the substrate surface or wafer to be polished. The openings are configured into a number of groupings so that a separate channel with a controlled pressure is used for each grouping. It is in this manner that the gas pressure for each grouping can be separately and independently controlled. The individualized regulated pressures may be within the pressure range of between $1.5\times10^3$ mm Hg to $10^{-3}$ Hg. The ability to control gas pressure at various and specific sites on the wafer permits localized pressure adjustments and ensures that the pad-substrate contact is maintained at the desired levels thereby ensuring a uniform rate of polish along the entire surface of the surface being polished.

DETAILED DESCRIPTION OF THE PREFERRED EMBODIMENT

The invention is designed to control the amount of pressure applied to the wafer, affording the ability to increase or decrease the pressure exerted on a plurality of areas of the wafer. This inventional allows for individual mapping of differential pressures so that an area or group of holes exerts a greater or lesser pressure on a selected wafer area relative to neighboring wafer areas, thereby effecting a minute change in a wafer's polishing plane with respect to the plane of the polishing pad, hence, providing the ability to adjust for minute undulations formed after polishing of a previously polished wafer.

Figure 1:
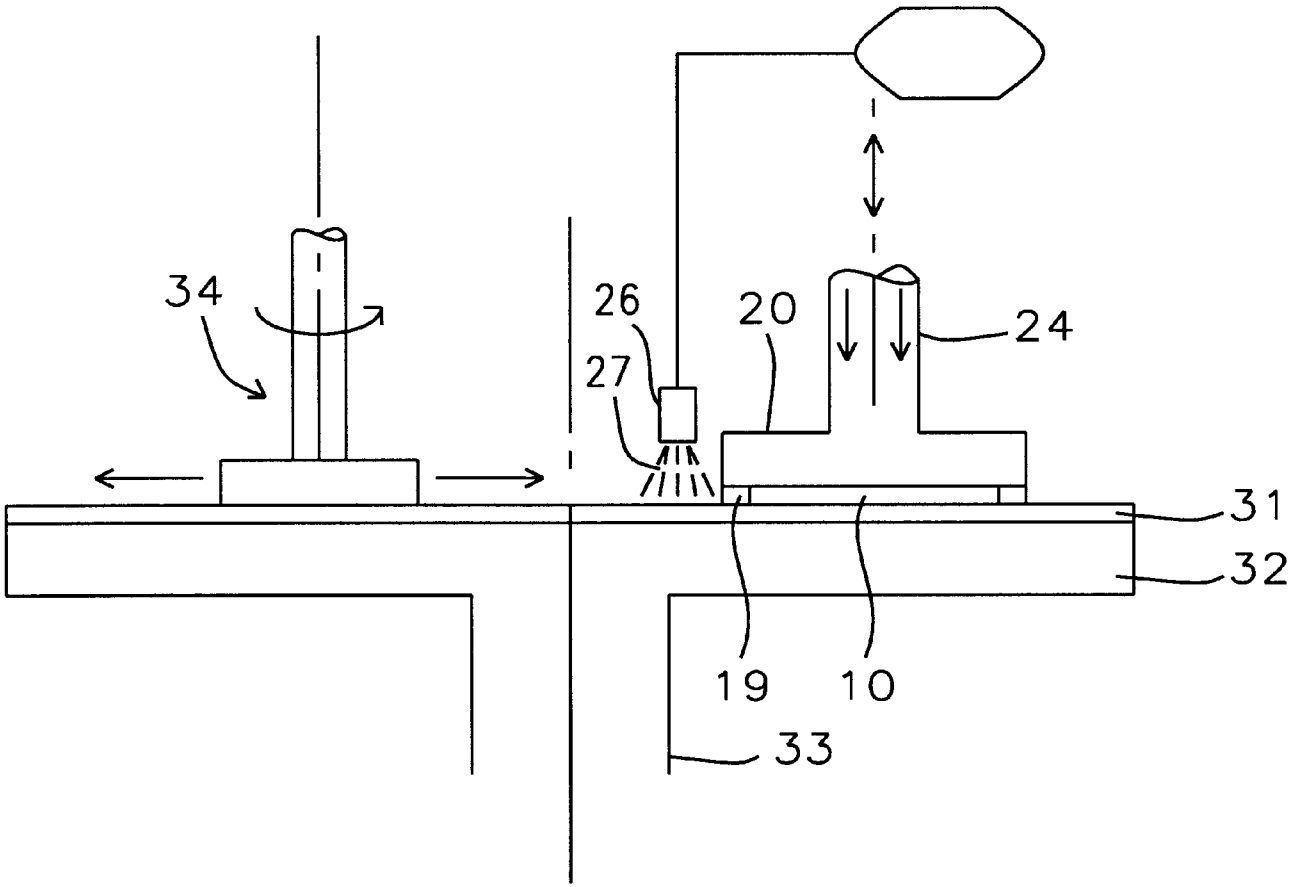
FIG. 1 is a schematic side view of a CMP apparatus according to the prior art.
Figure 2:
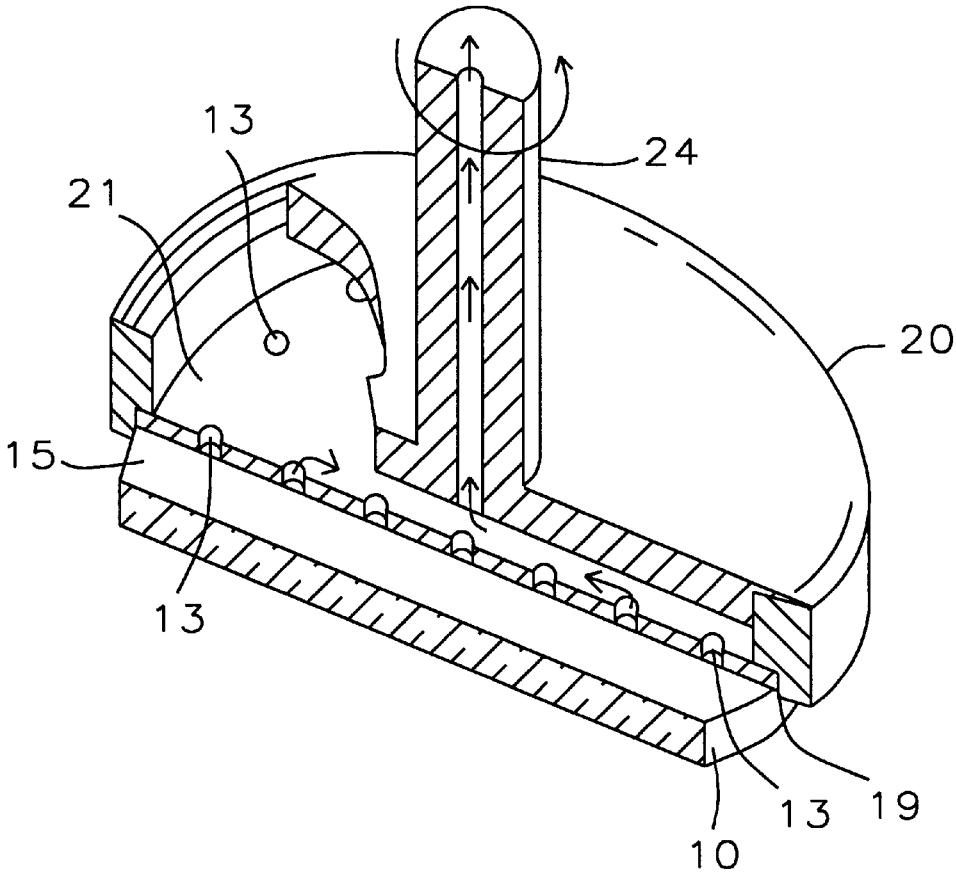
FIG. 2 is a cut-away view of a conventional CMP carrier of the prior art.

Referring now to FIGS. 1 and 2 there is shown a schematic of a conventional polishing tool according to the prior art, illustrating the arrangement of a chemical mechanical polishing platen used for planarization of a top surface topology of a semiconductor wafer. The following tutorial is relevant to the present invention, therefore will particularize the workings of the prior art.

A polishing pad 31 of a porous material is attached to the upper surface of a polishing platen 32. The polishing platen is horizontally supported by a platen rotating shaft 33, and is rotationally driven through the platen rotating shaft during the polishing operation.

A CMP carrier 20 having a lower surface opposed to the upper surface of the polishing pad 31 on the polishing platen 32. A nesting recess 19 releasably holds a wafer 10 to be polished. The CMP carrier is rotated by a spindle 24 driven from above by a driver motor. A nozzle 26 dispenses an abrasive polishing slurry 27 in the vicinity of the CMP carrier 20. A polishing pad dressing wheel 34 is used to recondition the polishing pad preventing glazing of the slurry on the polishing pad.

FIG. 2 illustrates a cut-away schematic view of a CMP carrier 20 of the prior art showing a cross-section taken along its vertical center. This perspective best illustrates its mechanical and functional characteristics. Shown is a fragmented semiconductor wafer 10, its back side 15 held to the base 21 of the carrier 20 by a vacuum pressure. The base having a pattern of holes 13 to allow a gas to be either evacuated or to flow out. The gas used during a positive pressure application is either nitrogen or a compressed dehydrated air supply. Generally, the wafer 10 to be polished is held in the carrier 20 using a vacuum pressure against the rear side 15 of the wafer. The carrier also has a retaining lip 19 fitting around the wafer's periphery thereto recessing the wafer and keeping the wafer centered on the carrier. The front side of the wafer, the side to be polished, is then placed in contact with a soft material such as a polishing pad 31 that is supported from underneath by a rotatable platen 32. The polishing pad 31 may have an abrading slurry 27 sprayed on it, or abrasive particles affixed to it, or abrasive particles sprinkled on it The rear side of the wafer 15 is held by its carrier 20 by way of a vacuum pressure while the front side of the wafer is placed in contact with a polishing pad. The holes 13 are arranged in a reconfigured pattern so that after the wafer is conveyed and placed on the polishing pad, the wafer carrier holding and rotating the wafer is forced against the rotating polishing pad applying a controlled pressure needed for polishing. Additionally, the vacuum pressure holding the wafer can be replaced with a positive gas pressure, from a single source, forcing the wafer against the polishing pad.

The present invention describes a technique for controlling the polishing rate across a substrate surface during polishing by applying different pressures to a plurality of designated sites of any configuration. A support housing includes a plurality of openings through a shaft for individualized regulated gas pressures. These openings are arranged in a reconfigured pattern to the substrate surface or wafer to be polished. The openings are configured into a number of groupings so that a separate channel with a controlled pressure is used for each grouping. It is in this manner that the gas pressure for each grouping can be separately and independently controlled. The individualized pressures may be adjusted within the range of between $7\times10^{2}$ mm Hg to $10^{-3}$ mm Hg. The ability to control gas pressure at various and specific sites on the wafer permits localized pressure adjustments and ensures that the pad-substrate contact is maintained at the desired levels thereby ensuring a uniform rate of polish along the entire surface of the surface being polished.

Figure 3:
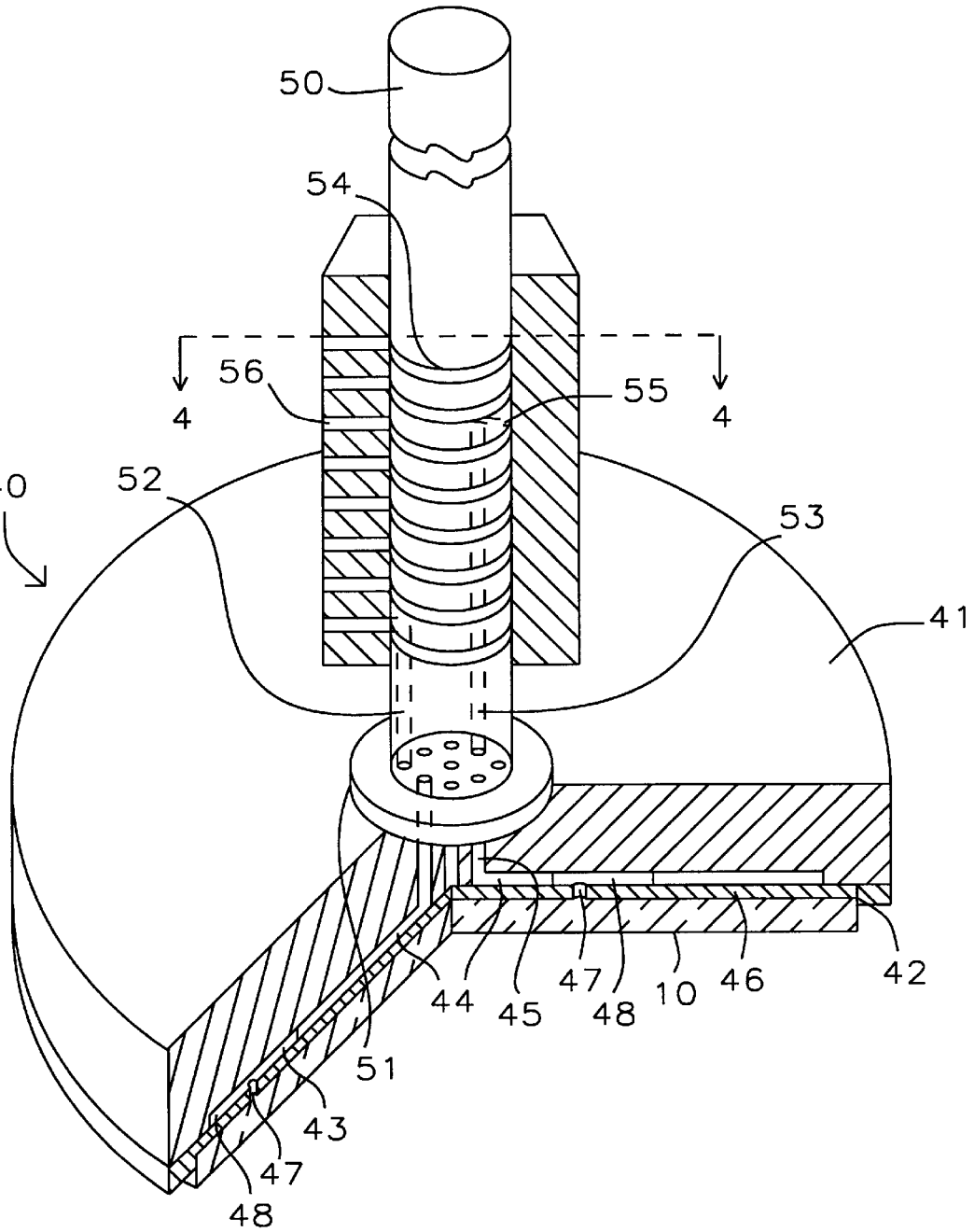
FIG. 3 is an illustration of a partial cross-section of a perspective view, of the invention, showing the packaging of a multiple gas pressure supply.
Figure 4:
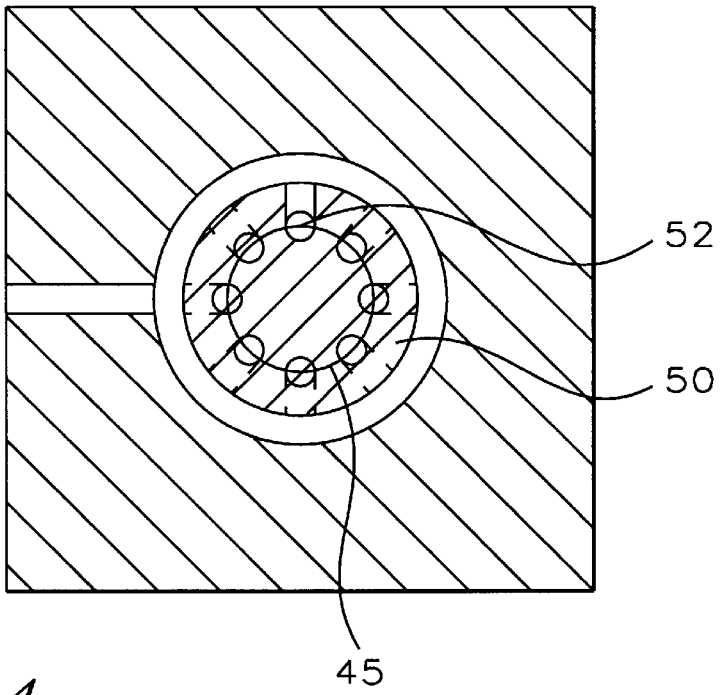
FIG. 4 is a cross-section through the journal and spindle showing a top perspective view at the circular pattern of the longitudinal conduits.
Figure 5:
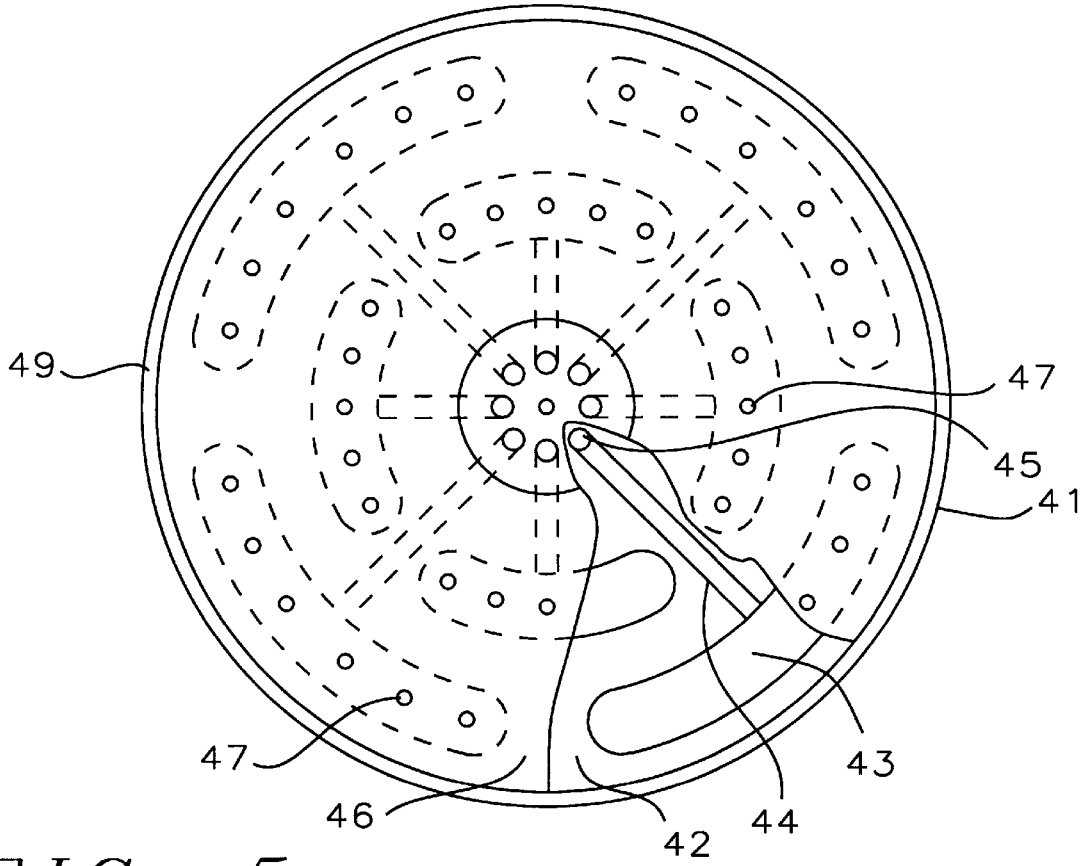
FIG. 5 illustrates a bottom view of a multiple plenum CMP carrier of the invention and how the apparatus can supply different gas pressures to different areas on the wafer

Referring now to FIGS. 3, 4 and 5 illustrating an apparatus 40 for removably positioning a semiconductor wafer 10 for polishing. The apparatus including a rotating member 41 with a major lower surface 42 having a plurality of recesses 43 each with a conduit path 44 radially leading to a smaller circular pattern 45 of portholes 52 disposed near the center of the rotating member, the recesses 43 are arranged in concentric segments. A nozzle plate 46 covers the major lower surface defining a plurality of chambers 48 therebetween. The nozzle plate includes a radial pattern of gas dispensing orifices 47 which are aligned centrally relative to each chamber 48. A preset regulated gas pressure communicates with each orifice pattern to exert an opposing force against a force urging the article against the polishing pad. At least two of the orifice patterns have gas pressures adjusted independently from one another so that independent pressure control 48 creates varying forces to be exerted against the back side of the wafer.

Figure 6:
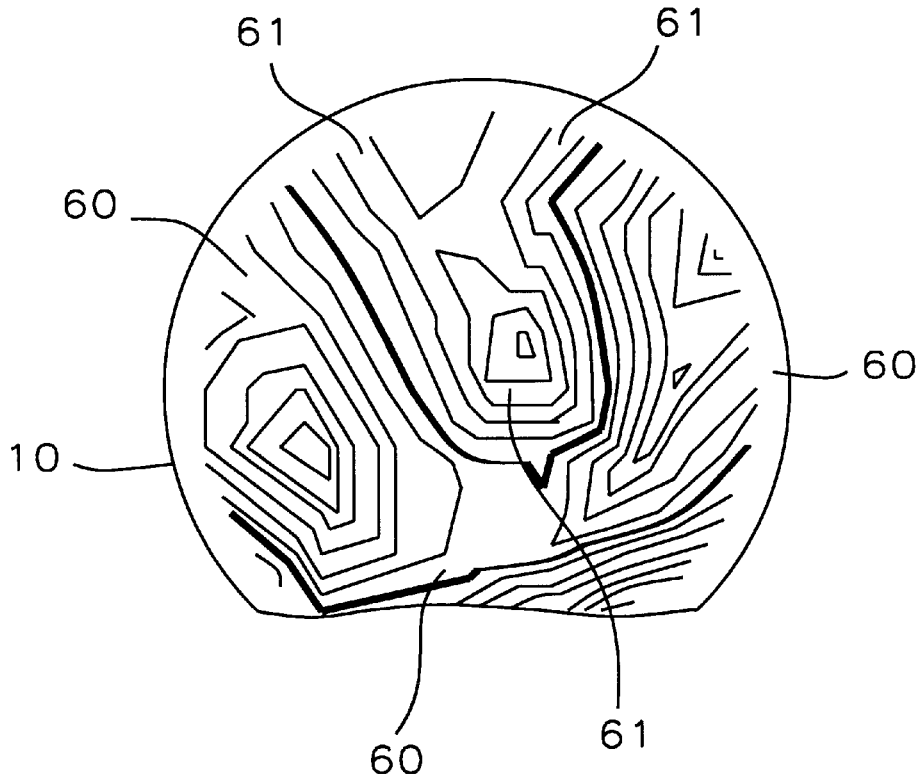
FIG. 6 shows a topological presentation of a wafer after polishing.

A ring 49 is secured to the major lower surface 46 of the rotating member adapted to centrally position and partially recess the back side of the wafer 10. The major lower surface is oriented substantially parallel to the upper surface of a rotating polishing pad. The apparatus has a rotatable axis which is parallel and offset relative to the rotatable axis of the polishing pad. A spindle shaft 50, with a first end 51 shown fixidly attached to the top surface of the rotating member 41. The first end 51 of the spindle shaft 50 has a plurality of longitudinal conduits forming a small circular pattern at the first end and progressively vary in length, longitudinally, and at fixed intervals. The small circular pattern formed at the first end aligns with the porthole pattern in the rotating member 41. The plurality of longitudinal conduits each communicate with with its own external groove 54 through a port 55 which intersects with a longitudinal conduit that has the same vertical distance, which, by design, intersects with a depth matching conduit. A stationary journal block shown vertically cross-sectioned has a plurality of gas supply ports 56 which are vertically spaced apart to align with the external grooves 54 in the spindle shaft 50. This invention provides means to vary the forces acting on specific areas on the back side of a wafer to improve the planarity of a polished wafer. FIG. 6 is a topological drawing of the problem this invention solves, that is the high plateaus 60 and low valleys 61 one finds on a wafer 10 after polishing when uniform pressure is applied over the entire wafer surface. The drawing also illustrates how the preferred embodiment is able to configure irregularly-shaped areas to be polished to uniformity.

While the invention has been particularly shown and described with reference to the preferred embodiments thereof, it will be understood by those skilled in the art that various changes in form and details may be made without departing from the spirit and scope of the invention.

What is claimed is:

1. In an equipment used to polish a planar article having a frontside surface and a backside surface in which the article is lifted by said backside surface and placed upon a rotating polishing pad for polishing said frontside surface, an apparatus for removably positioning said article for polishing, comprising:

a rotating member having a major lower surface with a plurality of recesses each with a conduit path radially leading to a smaller circular pattern of portholes disposed near the center of said rotating member, said recesses arranged in concentric segments;

a nozzle plate covering said major lower surface defining a plurality of chambers therebetween, said nozzle plate providing radial patterns of gas dispensing orifices aligned centrally relative each chamber, wherein a preset regulated gas pressure communicating to each orifice pattern exerts a preset opposing force against a force urging said article onto said polishing pad;

at least two of said orifice patterns having its gas pressure adjusted independently from one another such that independent pressure control permit varying forces to be exerted against the back side of said article.

2. The apparatus of claim 1 further comprising:

a ring secured to the major lower surface of said rotating member adapted to centrally position and partially recess the back side of said article, said major lower surface is oriented substantially parallel to said upper surface of a polishing pad, said rotating member has a rotatable axis which is parallel and offset relative to a rotatable axis of said polishing pad;

a spindle shaft, with a first end fixidly attached to the top surface of said rotating member, said first end of spindle shaft having a plurality of longitudinal conduits machined at progressive depth intervals, said longitudinal conduits form a small circular pattern at said first end aligning with porthole pattern in said rotating member, said longitudinal conduits each communicate with an external groove via a port that intersecting a depth matching conduit, and a stationary journal bearing having a plurality of gas supply ports which are separated longitudinally to align with said external grooves in said spindle shaft.

3. The apparatus of claim 2 wherein said spindle shaft having a multiplicity of external grooves said spindle shaft is placed within the bore of a plain cylindrical journal block said spindle shaft and the mating bore are burnished to a mirror finish and lubricated with a vacuum grease.

4. The apparatus of claim 1 wherein lifting said article requires a low vacuum pressure.

5. The apparatus of claim 1 wherein said regulated gas pressures may be set independently within a pressure range of between 1520 mm Hg to 25 mm Hg.

6. The apparatus of claim 1 wherein said nozzle plate is a rigid planar reference surface.

7. The apparatus of claim 1 wherein said plurality of chambers and conduits are sealed to prevent leakage and leak.

8. The apparatus of claim 7 wherein sealing said chambers and conduits are taken from the group including elastomeric o-rings, epoxy vacuum sealant, and vacuum pastes.

9. The apparatus of claim 7 wherein sealing said chambers and conduits are taken from the group including elastomeric o-rings, epoxy vacuum sealant, and vacuum pastes.

10. The apparatus of claim 1 wherein the ability to adjust the gas pressure to different areas of the article provides a method to fine tune and to reduce the high plateau and valley topography measured after a CMP operation.

11. In an equipment used to polish a planar article having a frontside surface and a backside surface in which the article is lifted by said backside surface and placed upon a rotating polishing pad for polishing said frontside surface, a method for removably positioning said article for polishing, comprising the steps of:

providing a rotating member having a major lower surface with a plurality of recesses each with a conduit path radially leading to a smaller circular pattern of portholes disposed near the center of said rotating member, said recesses arranged in concentric segments;

a nozzle plate covering said major lower surface defining a plurality of chambers therebetween, said nozzle plate providing radial patterns of gas dispensing orifices aligned centrally relative each chamber, wherein a preset regulated gas pressure communicating to each orifice pattern exerts a preset opposing force against a force urging said wafer onto said polishing pad;

at least two of said orifice patterns having its gas pressure adjusted independently from one another such that independent pressure control permit varying forces to be exerted against the back side of said wafer;

a ring secured to the major lower surface of said rotating member adapted to centrally position and partially recess the back side of said wafer, said major lower surface is oriented substantially parallel to said upper surface of said rotating polishing pad, said rotatable polishing head assembly has a rotatable axis which is parallel and offset relative to a 9 rotatable axis of said polishing pad;

a spindle shaft, with a first end fixidly attached to the top surface of said rotating member, said first end of spindle shaft having a plurality of longitudinal conduits machined at progressive depth intervals, said longitudinal conduit form a small circular pattern at said first end aligning with porthole pattern in said rotating member, said longitudinal conduits each communicate with an external groove via a port that intersecting a depth matching conduit, and a stationary journal bearing having a plurality of gas supply ports which are separated longitudinally to align with said external grooves in said spindle shaft.

12. The method of claim 11 wherein lifting said article requires a low vacuum pressure.

13. The method of claim 11 wherein said regulated gas pressures may be set independently within a pressure range of between 1520 mm Hg to 25 mm Hg.

14. The method of claim 11 wherein said nozzle plate is a rigid planar reference surface.

15. The method of claim 11 wherein said plurality of chambers and conduits are sealed to prevent leakage and leak.

16. The method of claim 11 wherein the ability to adjust the gas pressure to different areas of the article provides a method to fine tune and to reduce the high plateau and valley topography measured after a CMP operation.

17. The method of claim 11 wherein said spindle shaft having a multiplicity of external grooves said spindle shaft is placed within the bore of a plain cylindrical journal block said spindle shaft and the mating bore are burnished to a mirror finish and lubricated with a vacuum grease.

* * * * *